US005784753A

United States Patent [19]

Kaczmarz et al.

[11] Patent Number: 5,784,753

[45] Date of Patent: Jul. 28, 1998

[54] CARPET SPOTTING MACHINE WITH THERMOSTATIC PROTECTION AGAINST OVERFLOW

[75] Inventors: Kenneth A. Kaczmarz, Hoffman Estates; Jesse V. Mondigo, Aurora; Gary Edward Palmer, Roselle, all of Ill.

[73] Assignee: Minuteman International, Inc., Addison, Ill.

[21] Appl. No.: 778,041

[22] Filed: Dec. 26, 1996

[51] Int. Cl.[6] ..... A47L 9/28

[52] U.S. Cl. ..... 15/319; 15/321

[58] Field of Search ..... 15/319, 320, 321, 15/339, 353

[56] References Cited

U.S. PATENT DOCUMENTS

| | | | |
|---|---|---|---|
| 4,512,057 | 4/1985 | Laing et al. | 15/320 |
| 4,827,562 | 5/1989 | Blase et al. | 15/321 |
| 4,910,828 | 3/1990 | Blase et al. | 15/321 |
| 5,243,732 | 9/1993 | Koharagi et al. | 15/319 |

OTHER PUBLICATIONS

Technical Bulletin E2–VBG–001—By–Pass Vacuum Motor by Ametek—Lamb Electric Division No Date.

Technical Bulletin E2–VT570–001—Thru–Flow Vacuum Motor by Ametek—Lamb Electric Division No Date.

*Primary Examiner*—Terrence Till
*Attorney, Agent, or Firm*—Emrich & Dithmar

[57] ABSTRACT

A portable carpet cleaning machine has a tank for storing a cleaning solution and a hand-actuatable spray nozzle for applying the solution under pressure. A vacuum motor drives a fan which produces a vacuum in a recovery tank for storing spent solution. Air flows through the recovery tank and the vacuum fan to exhaust. A fast-acting, heat-sensitive thermostatic switch is connected in electrical circuit and in heat transfer relation with the vacuum motor winding to interrupt the flow of current in the motor winding immediately upon sensing a temperature rise in the winding above a predetermined temperature and in a very short time after overflow water is passed from the recovery tank to the vacuum fan.

3 Claims, 3 Drawing Sheets

CARPET SPOTTING MACHINE WITH THERMOSTATIC PROTECTION AGAINST OVERFLOW

FIELD OF THE INVENTION

The present invention relates to a vacuum cleaner having a liquid recovery tank and adapted to suction or pick-up a fluid, such as spent cleaning fluid. In particular, the invention is directed to a system for protecting against overload of the motor of the vacuum cleaner in a wet pick-up vacuum where the size of the recovery tank or other considerations preclude the use of conventional float shut-offs.

BACKGROUND OF THE INVENTION

In understanding the present invention, it is important to understand two different types of motor/fan systems, the "bypass" system and the "flow through" system.

In wet pick-up vacuums and carpet cleaning machines, a bypass system is used. In a bypass system, a vacuum motor drives a vacuum fan to create suction by drawing in air through an inlet or suction nozzle. Dirt and spent cleaning solution are entrained in the air drawn in through the suction nozzle (called the "working air" as distinguished from the cooling air for the suction motor). Dirt, fluid and debris are removed from the stream of working air and deposited in a recovery tank or reservoir. The working air is circulated through the vacuum fan and then exhausted directly to atmosphere without cooling the motor.

A separate fan (typically driven by the same motor) moves cooling air through the motor to cool the windings. In this case, water is prevented from passing from the recovery tank to the suction motor, usually by means of a float shut off. It is important to have such protection because the load on the motor increases significantly if water passes through the motor and enters the vacuum fan housing. The increase in load on the vacuum motor is so significant that the motor becomes overloaded and the windings heat up very rapidly.

When the float interrupts the flow of working air in response to the water level reaching a predetermined level, there is no harm to the motor because the cooling air is continued to be supplied by the separate fan.

The motor must be continuously cooled to avoid overheating, which might damage the electrical insulation of the motor winding, or even presenting a fire hazard if the heat is allowed to accumulate. If the electrical insulation breaks down under heat, the windings may be exposed and may come in to contact with the motor housing, thereby providing a potential safety hazard.

The second type of motor/fan system, the "direct flow" system, routes the working air directly through the motor windings for cooling. The direct flow system does not need a separate cooling fan but it cannot be used in wet applications, either.

In order to prevent overheating of a vacuum motor in a direct flow machine, a conventional thermostatic interrupt switch is connected in series with the motor winding. This type of sensing system is slow acting, of the order of one-half hour or more. In a typical situation, if the air inlet to the motor is obstructed, the temperature of the motor rises slowly. Eventually the temperature of the motor will exceed a threshold and the thermostatic switch will open, permitting the motor to cool.

Carpet cleaning machines, as mentioned, typically employ a bypass system in which a float-operated switch shuts off the motor when the liquid level in the recovery tank reaches a certain level, preventing further operation of the machine. In conventional carpet cleaning machines, there is ample room for including a conventional float switch to protect the vacuum motor against having the overflow of liquid into the motor. A conventional carpet cleaning machine and is intended to clean large areas of carpet and is not easily carried from one area to another.

Within the last few years, a much smaller version of carpet cleaning machine has been developed and commercialized. It is more easily portable, and intended to clean much smaller areas (and thus is called a carpet "spotter"). A problem has arisen with carpet spotters—namely, the size of the solution recovery tank is so limited that there is insufficient room to include a float cut-off device in the recovery tank. A vacuum motor in a carpet spotter will be ruined if overflow water is taken into the motor inlet for more than approximately 30 seconds. The only solution to this potential problem to date has been to limit the capacity of the solution tank to be less than that of the recovery tank. But this does not prevent operator error from causing a problem—for example, if the operator fails to empty the recovery tank after filling the solution tank.

Because of these circumstances, carpet cleaning machines of this type, without a float motor protection system, have been unable to achieve listing with Underwriters' Laboratories.

SUMMARY OF THE INVENTION

The present invention employs a very quick reacting thermostatic circuit interrupter (i.e., switch) connected in series circuit with the motor winding of a wet pick-up machine or carpet spotter. The circuit interrupter is mounted in heat transfer relation with the motor winding so that the temperature of the thermostatic circuit interrupter switch will be the same as that of the motor winding, and the circuit interrupter has been designed, unlike those in the prior art, to have a reaction time of less than about 15 seconds. Such a short reaction time is preferable because the invention is specifically designed for overflow from the recovery tank of a portable carpet spotter. However, other applications could be conceived wherein the reaction time of the thermostatic circuit interrupter might be of the order of approximately 30 seconds or less, depending upon the application and the size of the motor.

Other features and advantages of the present invention will be apparent to persons skilled in the art from the following detailed description of a preferred embodiment accompanied by the attached drawing wherein identical reference numerals will refer to like parts in the various views.

DETAILED DESCRIPTION OF A PREFERRED EMBODIMENT

Figure 1:
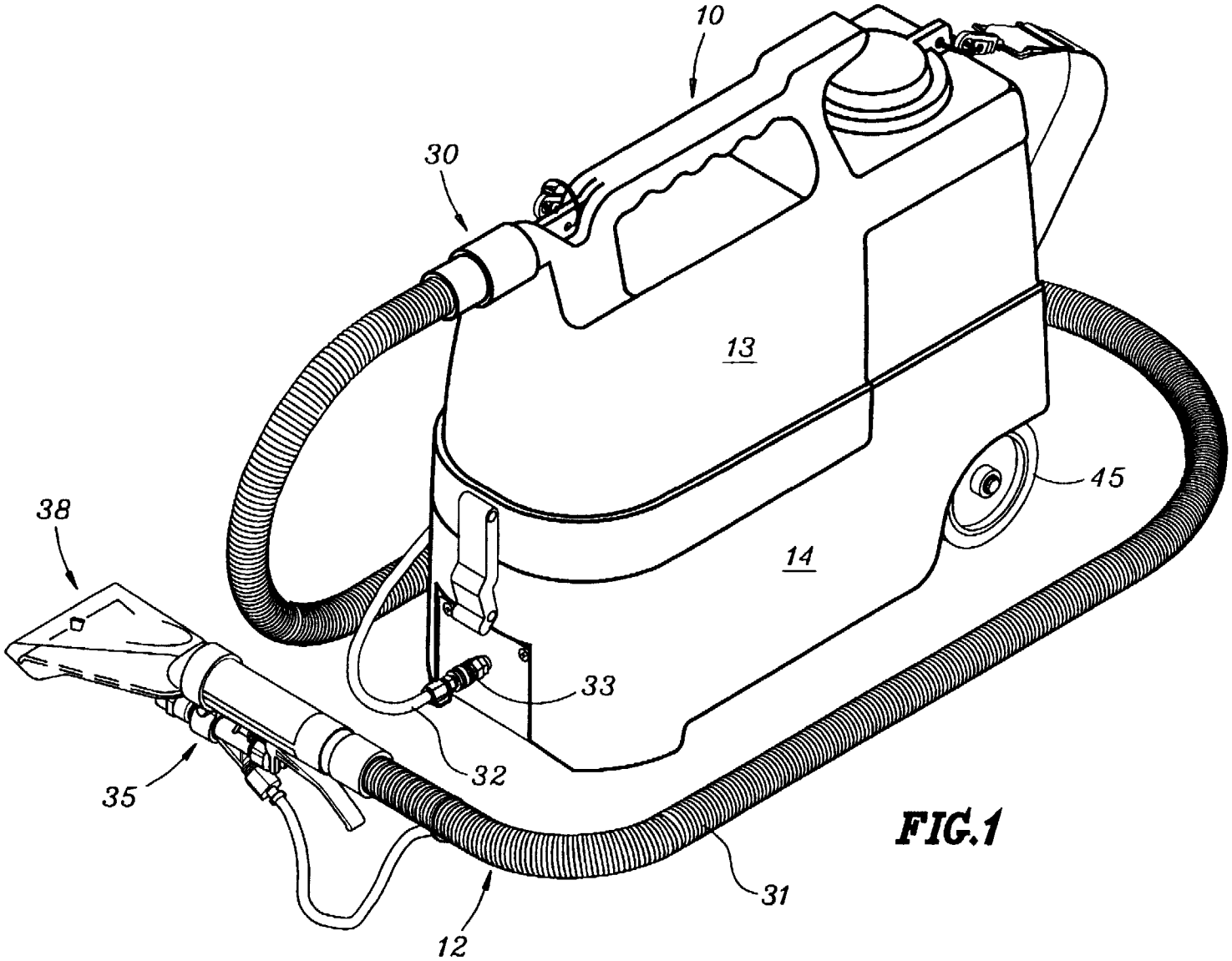
FIG. 1 is a perspective view of a carpet spotter machine incorporating the present invention.
Figure 2:
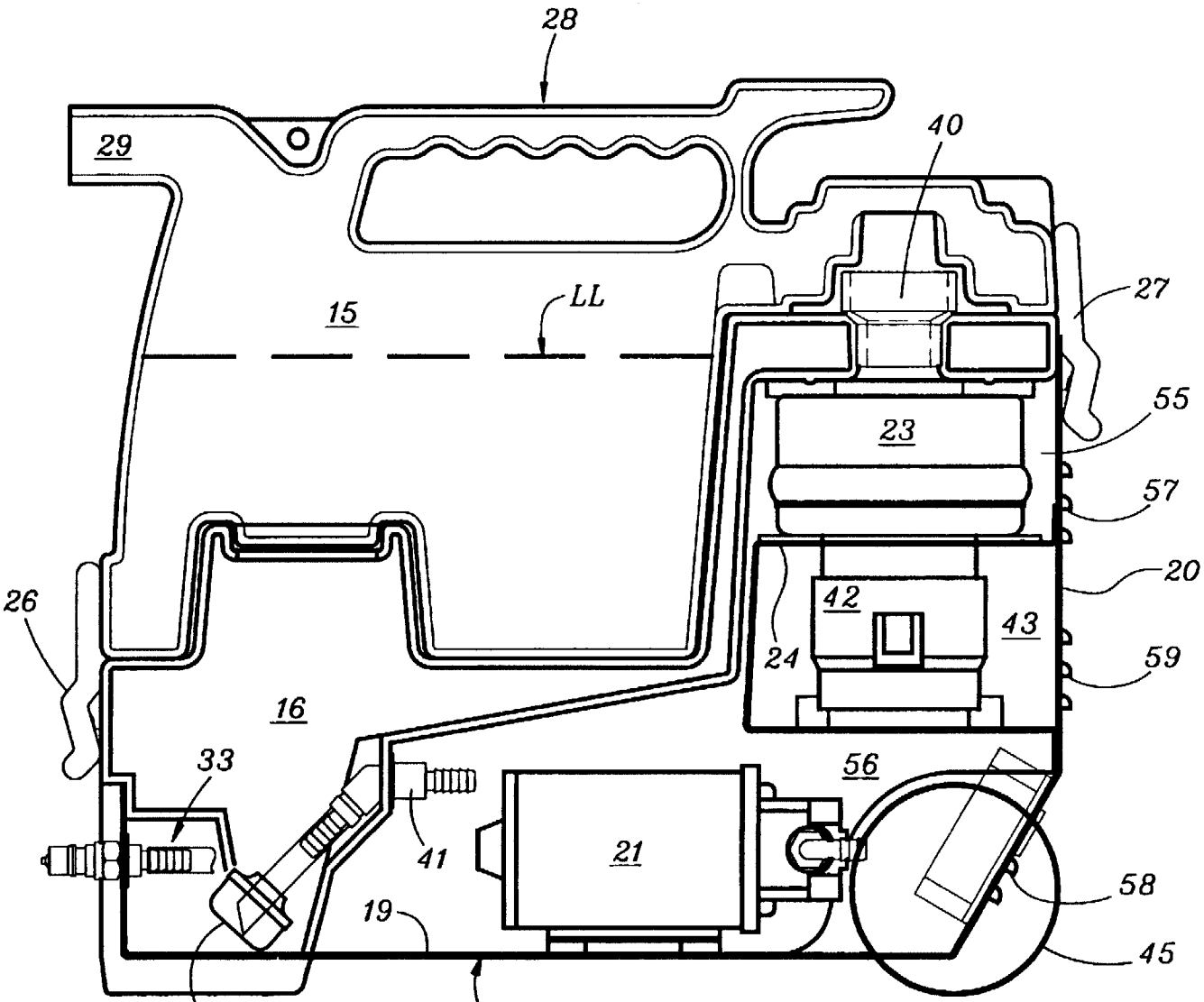
FIG. 2 is a vertical longitudinal cross-section view of the console of the machine of FIG. 1 without the suction hose assembly.

Referring first to FIG. 1, the carpet spotting machine shown in the drawing includes a console generally designated 10 and a suction assembly generally designated 12. The console includes a housing having an upper section 13 and a lower section 14. The upper console section 13 contains a recovery reservoir or tank, shown at 15 in FIG. 2. Similarly, the lower console section 14 houses a reservoir 16 which holds the cleaning solution to be applied to the surface being treated.

The console includes a sheet metal frame generally designated 18 which has a bottom wall 19 and an upright, rear wall 20. A pump 21 is mounted on the bottom wall 19 of the frame; and a vacuum motor 23 is mounted by means of a bracket 24 secured to the rear wall 20 of the frame.

The upper and lower console sections 13, 14 are designed to mate; and they are secured together in use by front and rear latches 26, 27. When the latches are unlatched, the upper console section 13 may be removed from the console by handle 28 for pouring out the spent solution contained in the recovery tank 15, the spent solution being discharged through suction inlet 29.

The suction assembly 12 includes a flexible suction hose 31 which is coupled to the suction inlet 29 of the console by means of a conventional adapter 30. The suction assembly also includes a solution tube 32 coupled to the interior of the cleaning solution tank by means of a coupling 33. The other end of the solution tube 32 is connected to a conventional hand-operated nozzle applicator generally designated 35 in FIG. 1. The nozzle applicator 35 is mounted to a conventional suction pick-up nozzle 38, the exhaust of which is connected to the flexible suction hose 31, again in a conventional manner.

Cleaning solution from the reservoir or tank 16 is drawn through a filtered take-up 44 and passes through a coupling 41 to the pump 21 (the connecting conduit is omitted for clarity). The cleaning fluid is then forced under pressure from the pump 21 through the coupling 33 and the tube 32 to the applicator nozzle 35 which sprays the cleaning fluid onto the area to be treated.

The spent solution and any debris that is recovered is taken up through the suction nozzle 38, and passed through the flexible hose 31 and the intake 29 into the recovery tank 15, where the fluid and solid materials are deposited. The suction or working air is separated as the fluid and solid materials are deposited in the recovery tank. The air passes through an inlet opening 40 in the suction motor 23. Air passes through the vacuum fan chamber 23 and is exhausted through vents 57 provided in rear wall of 20 of vacuum fan compartment 55. cooling air enters through vents 58 provided in rear wall 20 of cooling air intake compartment 56. Cooling air passes through cooling fan 42 which is housed in compartment 43 formed by bracket 24. After air passes through cooling fan 42 it passes through motor windings, cooling them, and is exhausted through vents 59 provided in rear wall 20 of compartment 43. The console 10, if desired, may be provided with a set of rear wheels, one of which is shown at 45 in FIGS. 1 and 2.

As a first precaution against liquid overflow from the recovery tank into the suction motor, the volume of the recovery tank 15 is made slightly larger than the volume of the solution tank 16. Thus, even if all the solution in tank 16 were recovered, it would only fill the recovery tank to the level indicated by the chain line designated LL in FIG. 2. However, as mentioned, operator error in refilling the solution tank without emptying the recovery tank can nevertheless result in a liquid overflow into the suction motor.

Figure 3:
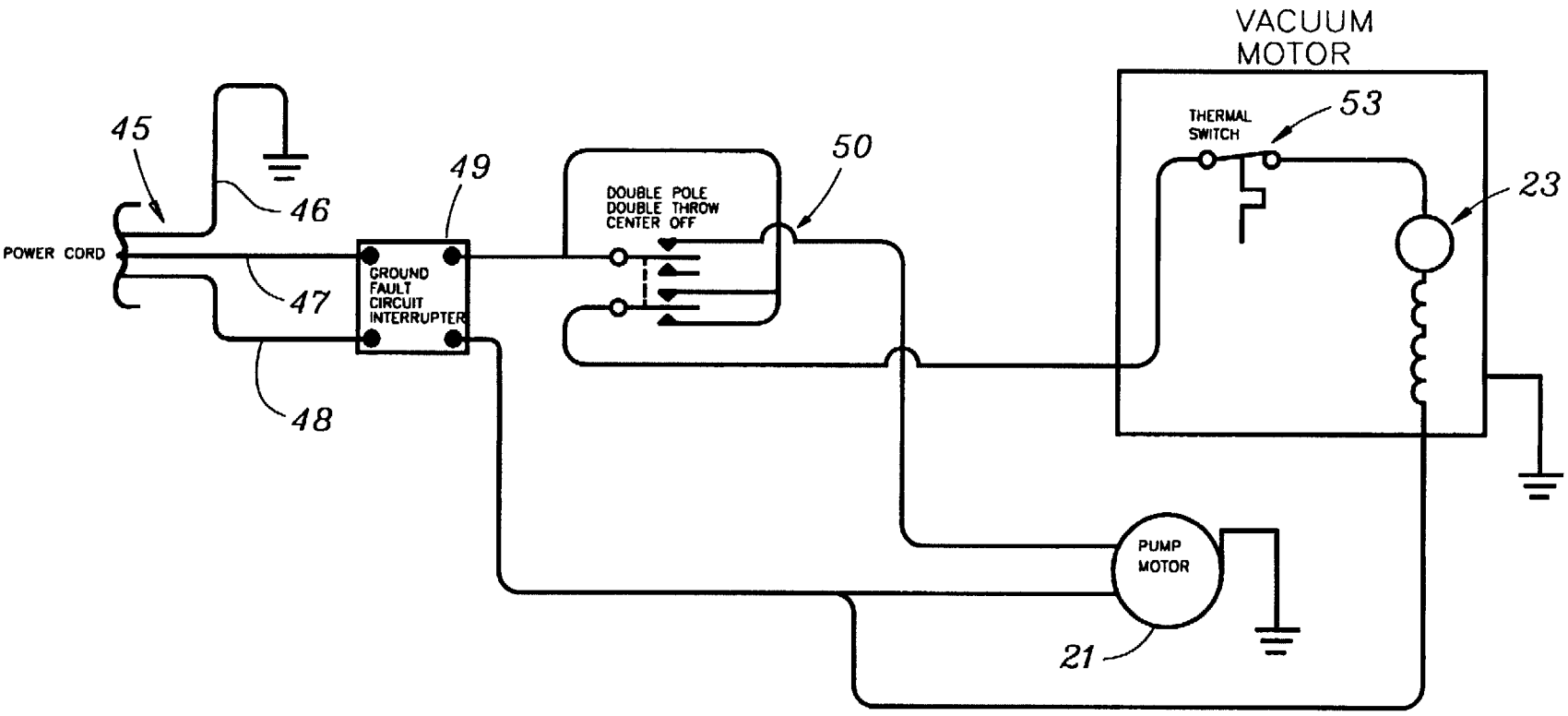
FIG. 3 is a schematic diagram of the electrical circuit of the machine shown in FIGS. 1 and 2.

Turning now to FIG. 3, there is shown an electrical schematic diagram of the motor circuit.

An inlet power cord generally designated 45 has a ground lead 46 and first and second power leads 47, 48. Power leads 47, 48 are fed to a ground fault circuit interrupter circuit 49, and one of the outputs of the ground fault circuit interrupter 49 is passed through a switch generally designated 50. The switch 50 is a double-pole, double-throw switch with a "center off" position. The second power lead from the ground fault circuit interrupter 49 and a lead from one "on" position ef switch 50 are fed to the pump motor 21. The second output lead of the switch 50 is fed through a thermostatic circuit interrupter switch generally designated 53 to the vacuum motor 23.

When the switch 50 is in the center position, both the pump 21 and the suction motor 23 are not energized. In one switch position (represented by the moveable contacts engaging the upper fixed contacts), power is fed to the pump motor 21 and to the vacuum motor 23 through the thermostatic circuit interrupter 53. In the other position, represented by the lower contact positions, power is coupled only to the vacuum motor, and not to the pump motor.

The thermostatic circuit interrupter 53 is a temperature-actuated circuit interrupter which is connected in series electrical circuit with the winding of the motor 23. The switch 53 is also physically located in the section of the motor which contains the motor winding so that the switch 53 is in physical contact and direct heat transfer relation with the motor winding. Further, the reaction time of the switch 53 is very short, preferably approximately 15 seconds from the time the sensed temperature reaches a predetermined level (140° C. preferably). The reaction time of the switch 53 may be as long as 30–35 seconds. The longer the reaction time before the interrupter switch 53 opens, the higher the probability of damage to the motor winding because the temperature rises within the motor 23 extremely quickly should any water within the recovery solution reservoir 15 pass through the inlet opening 40 of the suction motor 23.

A preferred form of the thermal interrupter switch 53 is Part No. 7AM209A5, manufactured by Texas Instruments Company of Attleboro, Mass.

Thus, with the use of a quick-acting thermal interrupter switch of the type described above, in the event of operator error or misjudgment, if an excess amount of water is accumulated in the recovery tank 15, it will spill over and enter the vacuum fan chamber. Due to the excessive load on the vacuum fan 42, the temperature of the windings of the motor 23 rises very quickly, but as soon as the temperature reaches a predetermined level (preferably 140° C.), the thermal switch 53 responds within 15 seconds of the time the temperature of the motor windings reaches the threshold, and the switch 53 opens. In addition to preserving the life of the suction motor 23, the use of the quick-reaction thermal interrupter 53 disclosed above obviates the need for a conventional slow-reacting thermostatic switch because these switches are conventionally set to interrupt at a higher temperature—approximately 160° C.

Having thus disclosed in detail a preferred embodiment of the invention, it will be apparent to persons skilled in the art that certain alterations may be made to the illustrated structure and equivalent components substituted for those disclosed while continuing to practice the principle of the invention; and it is, therefore, intended that all such modifications and substitutions be covered as they are embraced within the spirit and scope of the appended claims.

We claim:

1. In combination, a portable carpet cleaning machine having a tank for storing a cleaning solution; a hand-actuatable spray nozzle; a pump for feeding said solution to said nozzle under pressure; a vacuum recovery nozzle; a recovery tank for receiving spent solution from said vacuum recovery nozzle; a vacuum motor including a winding and adapted to produce a vacuum in said recovery tank, the air flowing from said recovery tank through said vacuum motor to exhaust; and a fast-acting, heat-sensitive thermostatic switch connected in electrical circuit with said motor and in heat transfer relation with said winding of said motor such that said thermostatic switch will interrupt the flow of current in said motor winding upon sensing a temperature rise in said winding above a predetermined temperature and less than about 30 seconds after overflow water is passed from said recovery tank to said vacuum motor.

2. The combination of claim 1 wherein said thermostatic switch is in direct, physical contact with said motor winding and constructed and arranged to interrupt the flow of current in said motor winding within less than about 15 seconds after overflow water passes to said vacuum motor.

3. The combination of claim 2 wherein said thermostatic switch is constructed and arranged to open when the temperature thereof reaches approximately 140° C.

* * * * *